US007971308B1

(12) United States Patent
Lawson

(10) Patent No.: US 7,971,308 B1
(45) Date of Patent: Jul. 5, 2011

(54) GOLF GRIP CLEANING AND RINSING DEVICE

(75) Inventor: Mike Lawson, Akron, OH (US)

(73) Assignee: Like New, LLC, Akron, OH (US)

( * ) Notice: Subject to any disclaimer, the term of this patent is extended or adjusted under 35 U.S.C. 154(b) by 804 days.

(21) Appl. No.: 11/961,014

(22) Filed: Dec. 20, 2007

(51) Int. Cl.
*A46B 11/00* (2006.01)

(52) U.S. Cl. ..... 15/104.92; 15/160; 15/21.2; 15/105

(58) Field of Classification Search ..... 15/104.92, 15/104.94, 88.1, 160, 21.2, 97.1, 105
See application file for complete search history.

(56) References Cited

U.S. PATENT DOCUMENTS 5,094,557 A 3/1992 Nelson et al.
5,269,615 A 12/1993 Lewis, Jr.
5,664,277 A 9/1997 Matlock
5,732,435 A 3/1998 Williams et al.
6,269,512 B1 8/2001 Thomson et al.
7,055,534 B2 6/2006 Goode et al.

*Primary Examiner* — Shay L Karls
(74) *Attorney, Agent, or Firm* — John D. Gugliotta, PE, Esq

(57) ABSTRACT

A grip cleaning and rising devices includes a dual tubular body having a closed lower end for holding separately both soapy and rinsing fluid, and an open upper end for receiving the grips or handles to be cleaned longitudinally therein. Cleaning is effected by a single helical brush with multiple turns that is simply threaded into position in the washing body. A splash guard is also provided as an impinging lip that extends into the receiving orifice. A smaller diameter rinsing tube is in fluid isolation from the cleaning solution. A cap may optionally be provided to close the top of the grip washer when not in use or for transportation from one place to another. The simple tubular construction enables the grip washer adapted for use as a mobile unit, with a laterally extending base to allow the user to stabilize the device by placing his or her feet over the base edge. The instant abstract is neither intended to define the invention disclosed in this specification nor intended to limit the scope of the invention in any way.

17 Claims, 3 Drawing Sheets

GOLF GRIP CLEANING AND RINSING DEVICE

RELATED APPLICATIONS

None.

BACKGROUND OF THE INVENTION

1. Field of the Invention

The present invention relates cleaning apparatuses, and more particularly, to an apparatus adapted for cleaning of handles and grips of golf clubs and like items 2. Description of the Related Art As is well known, the gripping portions of golf clubs, tennis rackets, and like items become sticky, greasy and generally dirty after use and over a period of time. As a result, the serious sportsman will have his or her grips replaced on a regular basis. Such replacement of golf grips can be troublesome and expensive, and will result in an unnecessary waste collection stream of used rubber golf grips into our landfills.

However, the prior grip washers tend to be ineffective or, alternately, relatively complicated, and correspondingly, relatively expensive. For example, U.S. Pat. No. 7,055,534, issued in the name of Goode et al., discloses articles, solutions, and methods for enhancing the grasping of and cleaning athletic equipment grips, in particular a golf club grip. These articles, solutions, and methods preferably comprise a water miscible solvent, a cleaning agent, and water to removes dirt, perspiration, water, and dried skin oils that have accumulated on the grip during the normal course of participating in athletic activity, while cleaning, drying, and restoring the natural tackiness of the grip. However, this wipe as sold by Grip Clean, LLP, the assignee, is basically an alcohol wipe, which will not effectively generate the desired result in that alcohol in not an appropriate solvent in that is does not restore tackiness of the grip and will actually dry out the material.

Also, U.S. Pat. No. 5,664,277, issued in the name of Matlock, discloses a golf grip cleaning device mounted on a support which is in turn mounted on a base. The base can be stationed at the tee box of the golf course or can be mounted on a golf car itself. However, such a device has no rinsing capacity, and the anticipated use at the tee box will inevitably slow down the pace of play unnecessarily.

U.S. Pat. No. 4,897,892, issued in the name of Bubien, discloses a golf club grip cleaner that is complex and motorized.

U.S. Pat. No. 6,269,512, issued in the name of Thomson et al., discloses a grip washer includes a tubular body having a closed lower end for holding cleaning fluid and an open upper end for receiving the grips or handles to be cleaned. A helical cleaning brush with multiple turns for cleaning the grips is threaded into position in the body. A second helical brush of a single turn threaded into the body and spaced above the cleaning brush provides a splash guard function during grip cleaning. However, such a device is without a rinsing source, and the anticipated anchoring mechanisms appear to be unbalanced and unworkable.

U.S. Pat. No. 5,732,435, issued in the name of Williams et al., discloses a device for cleaning golf-club heads, not the grips.

U.S. Pat. No. 5,269,615, issued in the name of Lewis, Jr., discloses a grip cleaning device for removing debris, sweat and/or other foreign matter from the grip material on athletic equipment such as golf clubs, rackets of all kinds and handle grips on bikes and the like. The device includes tufts with working ends defining a cleaning surface for the grip and an integral cleaning liquid dispenser.

Finally, U.S. Pat. No. 5,094,557, issued in the name of Nelson et al., discloses a golf club handle renovating device for cleaning and for removing an outer, weather-hardened rubber surface of a golf club handle to expose an underlying supply rubber surface includes a tube containing a plurality of stiff plastic blades attached at one end to the inner surface of the tube. The blades project inwardly from the inner surface of the tube so that a second end of the blades define a longitudinal central void adapted to closely receive the handle therein.

Some golf enthusiasts even suggest that their golf game is affected by a dirty grip (see e.g., Matlock, U.S. Pat. No. 5,664,277). Thus, there is a recognized need for grip and handle washers, and there are multiple prior patents disclosing a variety of prior grip washer arrangements.

SUMMARY OF THE INVENTION

It is therefore an object of the present invention to provide an improved golf grip cleaning and rinsing device comprising relatively few parts, which is easily assembled and disassembled, is portable and inexpensive, and which is capable of cleaning a golf grip with soap and providing a rinsing vessel all in one integrated design.

Briefly described according to a preferred embodiment, a grip cleaning and rising devices includes a dual tubular body having a closed lower end for holding separately both soapy and rinsing fluid, and an open upper end for receiving the grips or handles to be cleaned longitudinally therein. Cleaning is effected by a single helical brush with multiple turns that is simply inserted into position in the washing body and urged through spring force against the outer sidewall to provide sufficient tension to maintain the brush in place. A splash guard is also provided as an impinging lip that extends into the receiving orifice. A second rinsing tube, smaller in diameter due to absence of the inserted helical brush, is in fluid isolation from the cleaning solution. A cap may be provided to close the top of the grip washer when not in use or for transportation from one place to another. The simple tubular construction enables the grip washer adapted for use as a mobile unit, with a laterally extending base to allow the user to stabilize the device by placing his or her feet over the base edge.

An advantage of the present invention is that can utilize any number of soapy solvents to effectively implement cleaning of the golf grip.

Another advantage of the present invention is that a rinsing tube is also provided for rinsing the cleaning solution from the grip.

Further, a preferred embodiment of the present invention is portable, and includes no moving parts to allow for ease and simplicity of use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
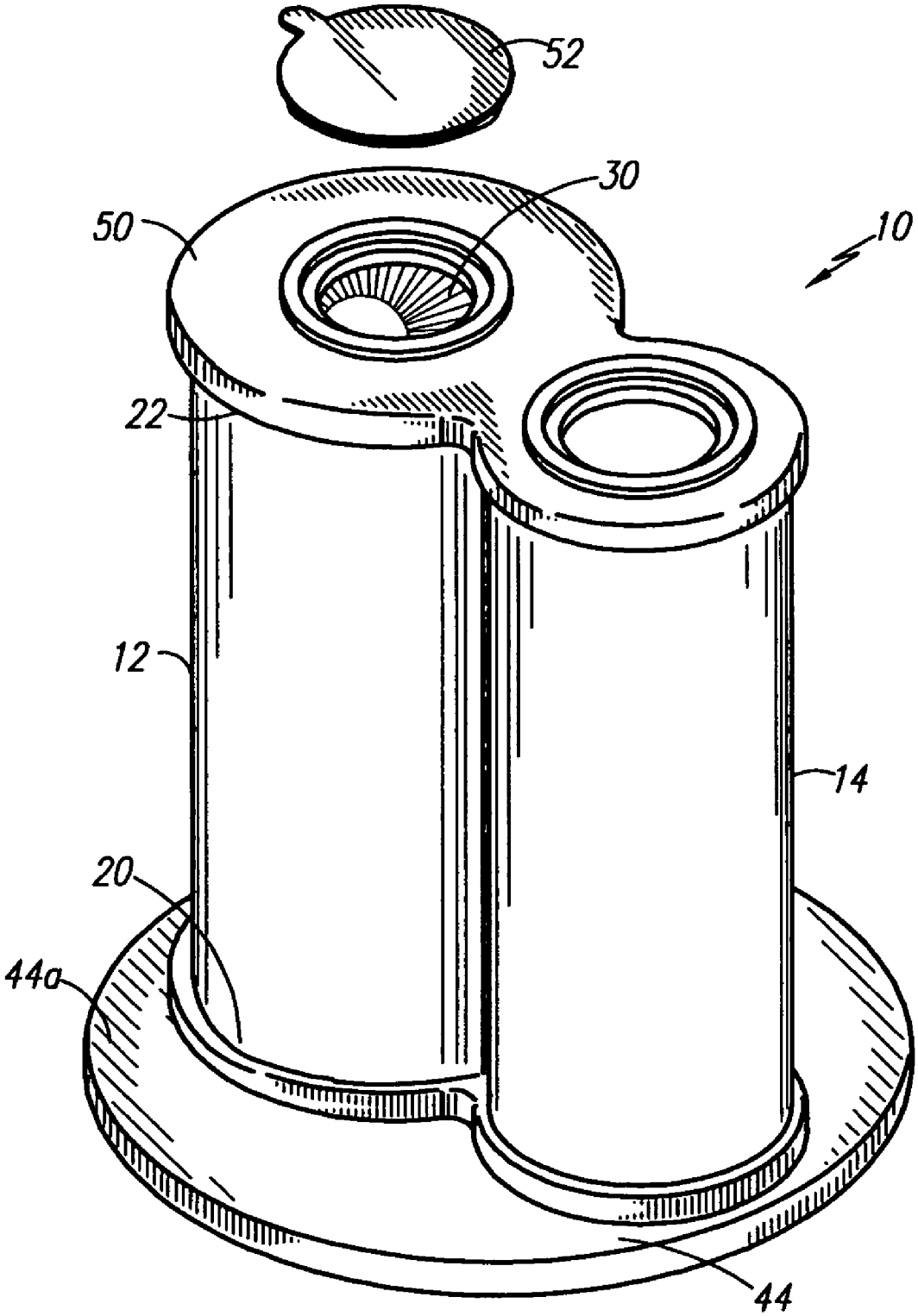
FIG. 1 is a front perspective view of a golf grip cleaning and rinsing device according to the preferred embodiment of the present invention.
Figure 2:
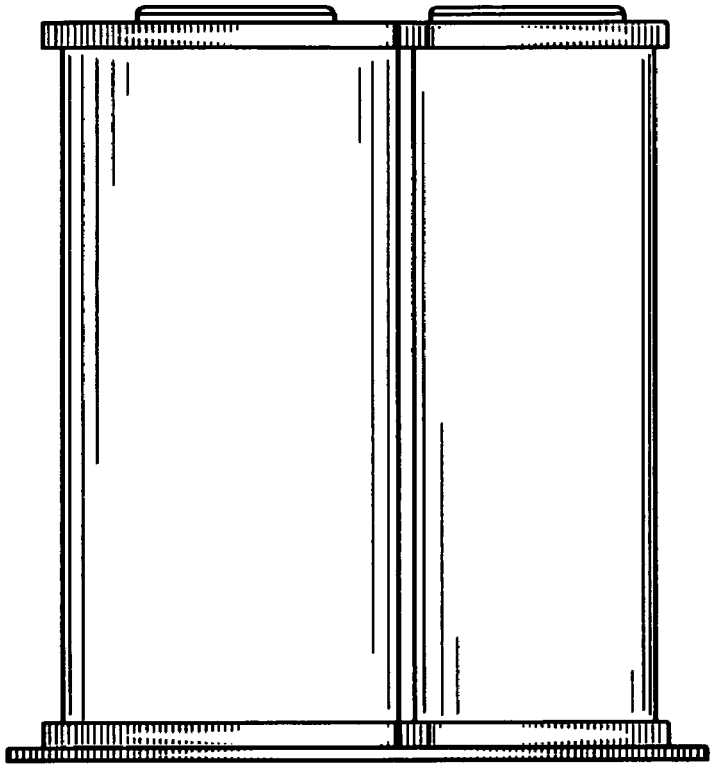
FIG. 2 is a front elevational view thereof.
Figure 3:
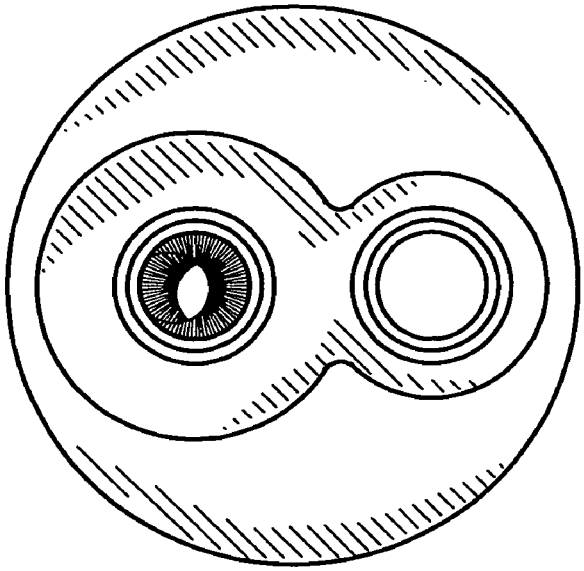
FIG. 3 is a top plan view thereof.

The best mode for carrying out the invention is presented in terms of its preferred embodiment, herein depicted within the Figures.

1. Detailed Description of the Figures

Referring now to FIGS. 1-4, a golf grip cleaning and rinsing device, generally noted as 10, includes a first vertically elongated washing tube 12 parallely aligned and connected to a co-extruded second vertically elongated rinsing tube 14. Both the washing tube 12 and rinsing tube 14 have a closeable lower end 20 and an open upper end 22. A helical cleaning brush 30, as described in greater detail below, is positioned in the washing tube 12. The closure of the lower end 20 can be accomplished by the use of a radially elongated stabilized base 44 which extends laterally outward from the washing and rinsing tubes 12, 14 respectively, such as to allow the user to place his or her feet on top of a base flange 44*a* in order to place sufficient stabilizing force as to prevent the device 10 from being inadvertently overturned.

Figure 4:
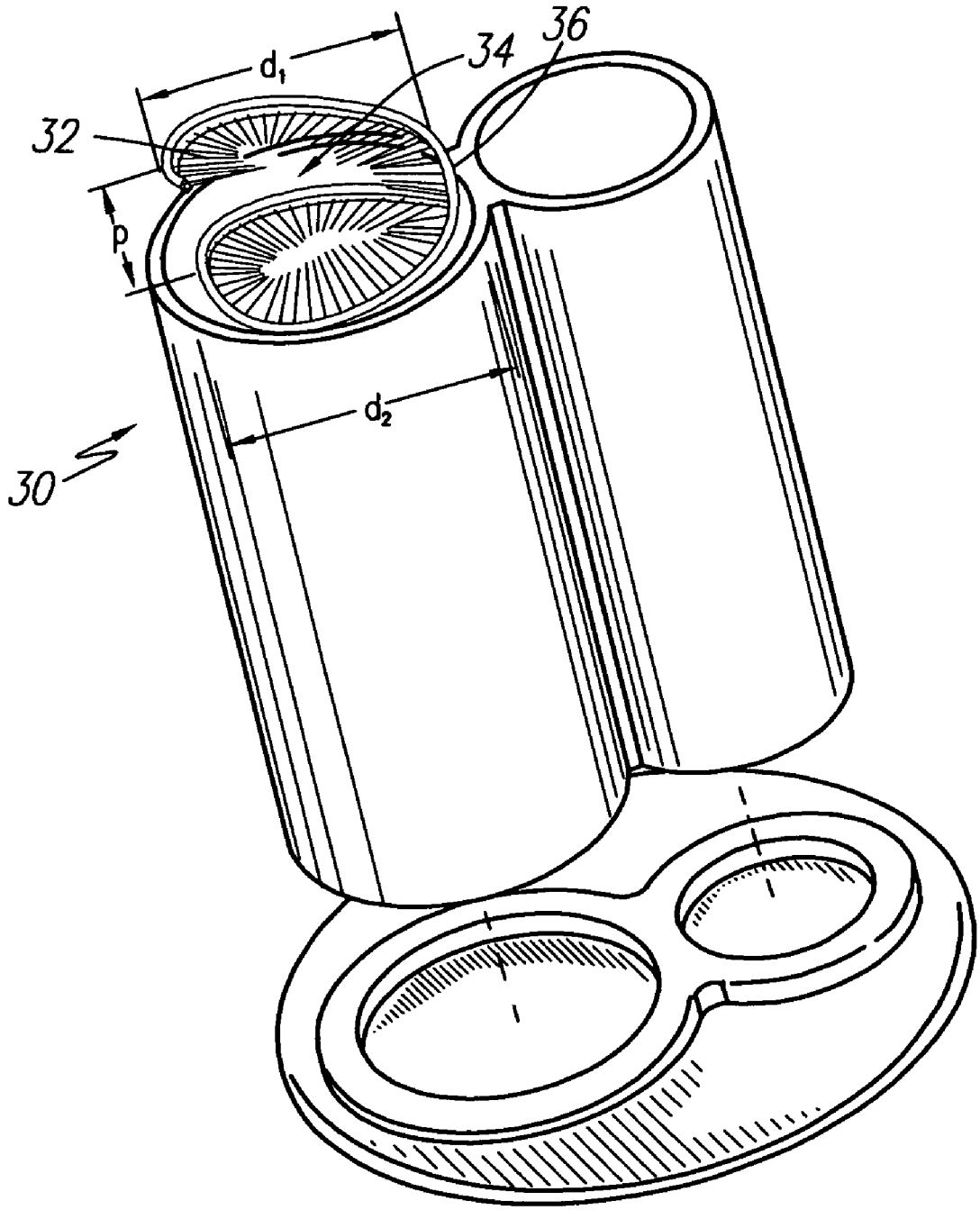
FIG. 4 is an exploded perspective view thereof.

As best shown in conjunction with FIG. 4, and more specifically, the preferred embodiments includes a helical brush 30 for cleaning handles and grips, and a splash guard 50 to prevent splashing of the cleaning fluid during use. The brushes are generally circular and of a type with a center hole for receiving a handle or grip of, preferably, a golf club. However, as one skilled in the art would anticipate, the teachings of the present invention could be similarly applied to other types of elongated sporting equipment other than golf clubs, for example, a tennis racket, baseball bat, racket ball racket, ski pole, fishing pole, and similar items having an elongated handle or grip for cleaning thereof. The helical brush 30 itself is anticipated as being formed as a compressions type coil spring in which the bristles 32 extend and are disposed inward toward a central cleaning channel 34 to receive an elongated cleaned element (such as a golf club handle and grip, not shown). The spine 36 of the coil 30 is formed spirally such that the overall outer diameter "$d_1$" is slightly larger than the overall inner diameter "$d_2$" of the first tube 12. In such a fashion, the overall brush coil 30 can be slightly elongated prior and during insertion into the first tube 12. This elongation or extension of the coil 30 causes the overall outer diameter "$d_1$" to decrease, allowing for easy insertion into the first tube 12 without interference or impingement. However, after release of the elongation, the coil 30 will tend to return back to its original configuration and dimension, thereby forming a frictional fit through the outward urging force between the spine 36 of the coil 30 and the inside surface of the first tube 12. Further, it has been found that with a coil 30 configured of a sufficient pitch "p" such that the overall coil 30 contains between 4 and 6 loops, and preferrably 5 to 5½ loops, forms an optimized configuration. Such and optimized configuration allows for: lowest cost of supply for the helical brush 30 (in that this cost represents the major cost of all components); sufficient outward urging tension to overcome the lateral up and down motions and forces caused by the act of cleaning a golf club grip, thereby maintaining the brush 30 in its intended configuration during use; and, sufficient length of brush 30 to effectively fill the available length of tube 12 and effectively clean a golf club grip.

In carrying out the invention, the washing and rinsing tubes 12, 14 respectively are of relatively simple construction and can be formed through extrusion, and can be coextruded as a single element or fabricated of separate, attached extruded components. The preferred brush 30 is a single helical brush with multiple turns, and includes radially extending bristles and a helical outer casing or spine 36 holding the bristles 32 in place. The bristles 32 have been engineered and selected of sufficient length to provide sufficient resistance to scrubbing, while at the same time not being so short as to create too stiff a configuration to cause excess effort and wear during the cleaning process. In this instance, the inside diameter of the washing tube 12 is designed to accommodate this bristle length, while at the same time creating and allowing an inward toward a central cleaning channel 34 of sufficient diameter to receive the elongated cleaned element desired.

In further carrying out preferred embodiments of the invention in the form of the commercial embodiment, the splash guard 50 is positioned above the brush 30, both to form an additional retaining impingement to the brush 30 as well as to prevent the cleaning fluid from splashing out during use of the grip washer 10. The splash guard may take any convenient form, adapted for retention in the body, to allow the handle to pass through to the brush, and to prevent splashing of the cleaning fluid as the handle is cleaned.

Additionally, a sealing cap 52 can be provided to mate to and seal the opening of the splash guard 50 to provide for spill-free transportation and storage of the grip washer when not in use.

From the foregoing, it will be apparent that the present invention brings to the art a new and improved grip washer which, (1) by virtue of providing dual vertically elongated tubes for separate washing and rinsing, (2) an optimized, self retaining helical cleaning brush; and (3) is easily disassembled and reassembled for cleaning and part replacement purposes.

2. Operation of the Preferred Embodiment

During use, the grip washer 10 is filled with a simple soap solution to a level at approximately the top of the brush 30, and the handle to be cleaned is inserted downwardly through the open upper end 16 and through the center of the brush, after which the handle is scrubbed with a combination of up-and-down and spinning movement, as desired.

After cleaning, the handle or grip is inserted into the rinse tube 14 to rinse any residual soap.

In accordance with the present invention, the grip washer 10 is of relatively simple construction, adapted to provide splash-free cleaning of handles and grips, and that can be easily adapted for free-standing or mobile use. As a result, the grip washer provides a convenient and relatively inexpensive means for washing handles and grips.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A golf grip washing and rinsing device comprising:

a portable housing adapted for containment of liquid and capture of debris formed of a first linearly elongated, vertical tubular body and a second tubular body coextensive with said first tubular body;

said first linearly elongated, vertical tubular body adapted for containing a liquid cleaning solution and forming an internal tubular space and having a closeable lower end and an open upper end portion;

a helical brush impingingly retained within said internal tubular space within said first elongated, vertical tubular body; and said second tubular body adapted for containing a rinsing fluid.

2. The golf grip washing and rinsing device as defined in claim 1 further comprising a splash guard positioned in said open upper end.

3. The golf grip washing and rinsing device as defined in claim 1 in which said brush includes radially extending bristles.

4. The golf grip washing and rinsing device of claim 1, wherein:

said first linearly elongated, vertical tubular body is adapted to contain a sufficient volume of liquid cleaning solution to adequately clean at least 14 golf club grips from an single charge of liquid cleaning solutions; and said second tubular body is adapted to contain a sufficient volume of water to adequately rinse at least 14 washed golf club grips and contain any associated debris resulting therefrom.

5. The golf grip washing and rinsing device of claim 4, wherein said portable housing is further adapted for batching and refilling of washing and rinsing fluids between subsequent usage.

6. A grip washing and rinsing device comprising:

a first vertically elongated washing tube being adapted for containing a washing solutions and parallely aligned and connected to a second vertically elongated rinsing tube being adapted for containing a rinsing solution, both said washing tube and rinsing tube having a closeable lower end and an open upper end, respectively;

a helical cleaning brush positionable within said washing tube; and a radially elongated stabilized base extending laterally outward from said washing and rinsing tubes, respectively, such as to allow the user to place his or her feet on top of a base flange in order to place sufficient stabilizing force as to prevent the device from being inadvertently overturned; and a splash guard in said open upper end to prevent splashing of internally retained fluid and containment of any removed debris during use.

7. The grip washing and rinsing device of claim 6, wherein said helical cleaning brush is formed as a compressions type coil spring having a plurality of bristles extend from a helical outer casing or spine for holding said bristles in place and disposed inward toward a central cleaning channel to receive an elongated cleaned element.

8. A grip washing and rinsing device of claim 7, wherein said central cleaning channel is adapted for cleaning an elongated cleaned element selected from the group comprising: golf clubs; tennis rackets; baseball bats; racket ball rackets; ski poles; and fishing poles.

9. A grip washing and rinsing device of claim 7, wherein said coil has a sufficient pitch "p" such that the overall coil contains between 4 and 6 loops.

10. A grip washing and rinsing device of claim 7, wherein said coil has a sufficient pitch "p" such that the overall coil contains between 5 to 5½ loops.

11. A grip washing and rinsing device of claim 7, wherein said spine of said coil is formed spirally such that its overall outer diameter "d1" is slightly larger than an overall inner diameter "d2" of said first vertically elongated washing tube.

12. A grip washing and rinsing device of claim 11, wherein said overall brush coil is slightly elongated prior and during insertion into said first tube such that such elongation or extension of said coil causes the overall outer diameter "d1" to decrease, allowing for easy insertion into the first tube without interference or impingement, and after release of the elongation, said coil returns back to its original configuration and dimension, thereby forming a frictional fit through the outward urging force between said spine of said coil and the inside surface of said first tube.

13. A grip wash and rinsing device of claim 12, wherein said coil has sufficient outward urging tension to overcome the lateral up and down motions and forces caused by the act of cleaning a golf club grip, thereby maintaining the brush in its intended configuration during use; and, said coil has sufficient length of brush to effectively fill the available length of tube.

14. A grip washing and rinsing device of claim 6, wherein said washing and rinsing tubes are formed coextruded as a single element.

15. A grip washing and rinsing device of claim 6, further comprising a sealing cap to mate to and seal an opening of said the splash guard.

16. The grip washing and rinsing device of claim 6, wherein:

said first elongated washing tube is adapted to contain a sufficient volume of liquid cleaning solution to adequately clean at least 14 golf club grips from an single charge of liquid cleaning solutions; and said second vertically elongated rinsing tube is adapted to contain a sufficient volume of water to adequately rinse at least 14 washed golf club grips and contain any associated debris resulting therefrom.

17. The grip washing and rinsing device of claim 16, wherein said first tube and said second tube form a portable housing that is further adapted for batching and refilling of washing and rinsing fluids between subsequent usage.

* * * * *